US010614703B1

(12) United States Patent
Franke

(10) Patent No.: US 10,614,703 B1
(45) Date of Patent: Apr. 7, 2020

(54) SYSTEM AND METHOD FOR CONTROLLING ANIMATED PROPS

(71) Applicant: Spencer Gifts LLC, Egg Harbor Township, NJ (US)

(72) Inventor: Carl Joseph Franke, Turnersville, NJ (US)

(73) Assignee: Spencer Gifts LLC, Egg Harbor Township, NJ (US)

( * ) Notice: Subject to any disclaimer, the term of this patent is extended or adjusted under 35 U.S.C. 154(b) by 0 days.

(21) Appl. No.: 16/185,818

(22) Filed: Nov. 9, 2018

Related U.S. Application Data

(60) Provisional application No. 62/592,145, filed on Nov. 29, 2017.

(51) Int. Cl.
*G08C 17/00* (2006.01)

(52) U.S. Cl.
CPC ..... *G08C 17/00* (2013.01); *G08C 2201/60* (2013.01)

(58) Field of Classification Search
CPC .... G08C 17/02; G08C 23/04; G08C 2201/92; G08C 17/00; G08C 2201/20; G08C 19/28; G08C 2201/30; G08C 2201/91; G08C 2201/21; G08C 19/00
USPC ..... 340/12.52
See application file for complete search history.

(56) References Cited

U.S. PATENT DOCUMENTS

| | | | | |
|---|---|---|---|---|
| 6,011,489 | A | 1/2000 | Ki Kwan et al. | |
| 6,319,010 | B1 * | 11/2001 | Kikinis | A63H 3/48 434/169 |
| 6,343,970 | B1 * | 2/2002 | Lee | A63H 3/28 446/297 |
| 6,727,826 | B1 | 4/2004 | Ki Kwan et al. | |
| 6,758,716 | B1 * | 7/2004 | Rehkemper | A63H 13/002 446/297 |
| 8,602,836 | B2 | 12/2013 | Wirt | |
| RE46,087 | E | 8/2016 | Wirt | |
| 2010/0128588 | A1 | 5/2010 | Shuman | |

* cited by examiner

*Primary Examiner* — Mark S Blouin
(74) *Attorney, Agent, or Firm* — Panitch Schwarze Belisario & Nadel LLP

(57) ABSTRACT

A system for activating a plurality of Halloween props with a single remote controller is provided. The system includes a remote controller and a plurality of remote receivers. Each of the remote receivers is connected to the Halloween prop via an activation port of the Halloween prop, e.g., a try-me or step pad port. The remote controller has a plurality of pushbuttons for accepting a user selection to be received by a respective remote receiver. Each of the pushbuttons corresponds to a Halloween prop that is connected with the respective remote receiver via the activation port.

13 Claims, 4 Drawing Sheets

SYSTEM AND METHOD FOR CONTROLLING ANIMATED PROPS

CROSS REFERENCE TO RELATED APPLICATIONS

This application claims priority to U.S. Provisional Patent Application No. 62/592,145, filed Nov. 29, 2017, the entire contents of which are incorporated herein by reference.

FIELD OF ENDEAVOR

Aspects of the present disclosure relate to systems and techniques that may be used to activate multiple Halloween props wirelessly from a remote location.

BACKGROUND

Halloween brings fun to children as well as adults, which is at least partially because of Halloween props. Some of the Halloween props are animated or have animations, which makes them spookier with more fun for children. These Halloween props can be controlled by a switch or a sensor or can be controlled by a dedicated controller from a remote location via a wired connection or a wireless connection. However, a Halloween prop with the dedicated wireless controller can be costly and inefficient because the dedicated wireless controller is configured to control only one Halloween prop.

Remotely controlled Halloween props can be more fun than Halloween props controlled via other means. For example, when one or more Halloween props are arranged in a user's (prank maker's) yard, an effect of playing the Halloween props would be enhanced if the user is able to activate the Halloween props in a predetermined pattern when someone, e.g., a trick-or-treater, passes or enters a vicinity of the user's yard.

Some currently-available animated Halloween props or Halloween props with animations are equipped with a try-me button or an activation port, e.g. a try-me port or step-pad port, to allow customers to experience the props in stores. For example, a Halloween prop can be activated by a wired controller via a respective activation port. In such case, the wired controller is connected with the Halloween prop by plugging a jack plug into the activation port. The wired controller may include a control switch, such as a footpad controlled switch or a try-me button, for triggering an activation signal to the Halloween prop. Because the activation port is designed for experiencing the Halloween prop in stores, the wired controller is not suitable for a remote use or a practical use, e.g., controlling a Halloween prop disposed in a yard from inside a house. In addition, because the wired controller is designed to connect to one Halloween prop, it is not suitable for activating a plurality of Halloween props with the single controller.

In view of the foregoing reasons, it may be desirable to have a system and method to activate a plurality of Halloween props with one controller from a selected remote location.

SUMMARY OF THE DISCLOSURE

Various aspects of the present disclosure may be directed to systems and techniques for activating one or more Halloween props (also referred to as a "prank-toy" or "prank apparatus"), each having an activation port, e.g., a try-me port or step-pad port, from a remote location. A system according to the present disclosure includes a remote controller and one or more remote receivers. The remote controller may have a plurality of pushbuttons for accepting user selections, each corresponding to a remote receiver that may be detachably connected to a Halloween prop. The remote receiver may be configured to receive a respective control signal and be connected with the Halloween prop via the activation port.

In use, a user may select to activate a Halloween prop by clicking a pushbutton of the remote controller. A wireless control signal may be issued to a selected direction or to a vicinity of the remote controller. A respective remote receiver may receive the control signal and transmit an electric current to the Halloween prop that the remote receiver is connected to. Then, the Halloween prop is activated to perform a predetermined program.

Some embodiments of the disclosed system further include a jack plug for connecting a remote receiver with a selected Halloween prop, where the jack plug is configured to plug into the activation port.

Various aspects of the disclosure may be embodied in the form of hardware, software, firmware, and/or combinations thereof. In the case of software or firmware, a non-transitory machine-readable medium, such as memory (e.g., but not limited to, ROM, RAM, flash, disk, etc.), may be used to store data and/or executable instructions that may be executed by one or more processing devices.

BRIEF DESCRIPTION OF ACCOMPANYING DRAWINGS

Various aspects of this disclosure will now be discussed in further detail in conjunction with the attached drawings, in which.

Figure 1:
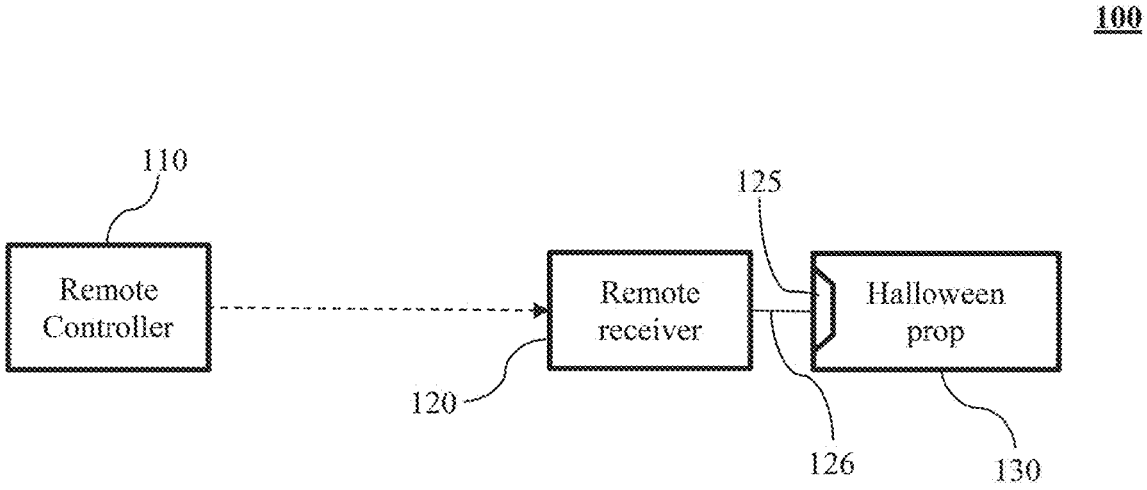
FIG. 1 shows a top-level block diagram of a system for activating Halloween props from a remote location according to an aspect of this disclosure.

It should be noted that the figures are not drawn to scale and that elements of familiar structures or functions are generally represented by like reference numerals for illustrative purpose throughout the figures. It also should be noted that the figures are only intended to facilitate the description of the various aspects of this disclosure, and therefore, do not illustrate every aspect of this disclosure and do not limit the scope of this disclosure.

DETAILED DESCRIPTION OF ASPECTS OF THE DISCLOSURE

Certain terminology is used in the following description for convenience only and is not limiting. The words "right," "left," "lower" and "upper" designate directions in the drawings to which the reference is made. The words "inwardly" and "outwardly" refer to directions toward and away from, respectively, the geometric center of the apparatus and designated parts thereof. The terminology includes the words above specifically mentioned, derivatives thereof and words of similar import.

Currently-available animated Halloween props may be equipped with activation ports, e.g., try-me or step-pad ports, but are rarely equipped with wireless remote control capacities. Even when a Halloween prop is equipped with the remote control capacity, a remote controller of the Halloween prop is normally configured to activate only one Halloween prop. Halloween prop control system for activating multiple Halloween props from a remote location would have advantages over single prop systems. This result may be achieved, according to one aspect of this disclosure, by an exemplary Halloween prop activating system 100 illustrated in FIG. 1.

Turning to FIG. 1, the Halloween prop activating system 100 includes a remote controller 110 and a remote receiver 120. In FIG. 1, the remote controller 110 (or a remote control) may be a component or an electronic device used to wirelessly operate a plurality of controlled devices disposed in a remote location. For example, the controlled devices may be Halloween props 130 disposed at a user site.

The remote controller 110 may issue an analog and/or digital signal in various signal types including, but not limited, an infrared signal, a radio frequency signal, a Bluetooth signal, a wireless internet signal, and the like. Depending on the signal type being used, the remote controller 110 may send a control signal in a particular direction that the remote controller 110 is pointed, such as a direction of a remote receiver 120, or to a vicinity of the remote controller 110. According to some aspects of this disclosure, when the control signal is an infrared signal, the control signal is sent in the direction that the remote controller 110 is pointed, and when the control signal is a radio frequency signal, the control signal is sent to the vicinity of the remote controller 110. The remote controller 110 may have a capacity to encode the control signal according to a selected protocol, thus, the control signal sent out by the remote controller 110 may be an encoded signal or a non-encoded signal.

The remote receiver 120 may be another electronic device that may receive the control signal sent out by the remote controller 110. Depending on the signal type of the remote controller 110, the remote receiver 120 may be configured to receive an infrared signal, a radio frequency signal or a Bluetooth signal. According to some aspects of this disclosure, the remote receiver 120 may have decoding capacity. If the control signal received by the remote receiver 120 is an encoded signal, the encoded signal may be decoded by the remote receiver 120. The remote receiver 120 may convert the control signal into an electric current for activating the Halloween prop 130.

The remote receiver 120 may include a wired link 126 for connecting to a Halloween prop 130 via an activation port 125, e.g., a try-me or step-pad port. The wired link 126 may be a conductive wire or a cable for connecting two electronic devices and/or for transmitting electronic signals between the two electronic devices. The remote receiver 120 may be detachably connected with the Halloween prop 130 via the wired link 126. Accordingly, the remote receiver 120 may be configured to connect with any selected Halloween prop 130 via the wired link 126 at a selected time. Thus, the remote controller 110 may be enabled to control any number and/or any types of Halloween props 130 that are connected with the remote receivers 120.

The Halloween prop 130 may be an animated Halloween feature or a feature with animation, which may be activated by running an electric current to a control circuit (not shown) of the Halloween prop 130. When a wireless control signal is received by a remote receiver 120, the control signal may be converted into the electric current for running into the control circuit of the Halloween prop 130. The electric current may be transmitted to the Halloween prop 130 via the activation port 125 of the Halloween prop 130 to activate the Halloween prop 130. When activated, the Halloween prop 130 may perform a predetermined program for a predetermined time duration.

Although shown and described as the Halloween props 130 for purposes of illustration only, the controlled device under this disclosure may be any type of prop with animations, e.g., dancing features, toys, devices and the like, as long as they are equipped with activation ports 125.

Accordingly, the Halloween prop activating system 100 may activate one or more Halloween props 130 individually or collectively in a selected manner with one remote controller 110. The Halloween props 130 may be of various types and/or products of various manufacturers. A user may activate the Halloween props 130 from a remote location as long as the Halloween props 130 are equipped with activation ports 125 that most animated Halloween props 130 commercially available in the market have for a purpose of promotion.

Figure 2:
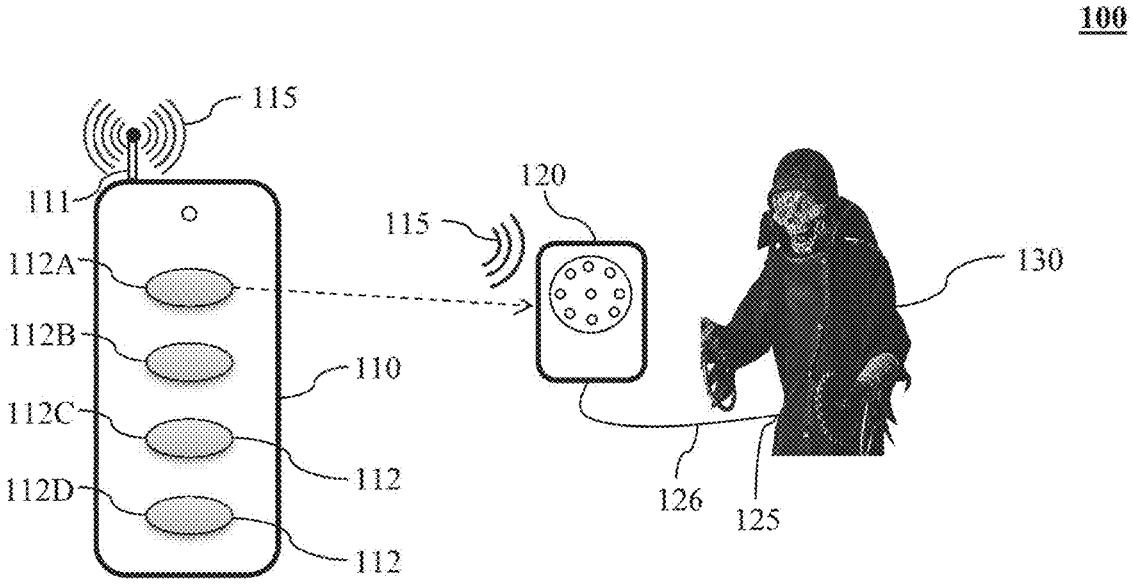
FIG. 2 shows a top-level conceptual diagram illustrating an example of the system of FIG. 1.

FIG. 2 illustrates an example of the Halloween prop activating system 100. In FIG. 2, the remote controller 110 may have a plurality of pushbuttons 112. Each of the pushbuttons 112 may be configured to remotely and/or wirelessly associate with a remote receiver 120. For example, a first pushbutton 112A may be associated with the remote receiver 120. The first pushbutton 112A may be associated with the remote receiver 120 via any suitable manner including, but not limited to, via a specific frequency, a specific coding or a specific wavelength of a control signal being sent by the remote controller 110.

According to some aspects of this disclosure, the remote controller 110 may be provided with an antenna 111 that may be configured to transmit a control signal into a vicinity of the remote controller 110 when the control signal is a radio signal in a predetermined frequency. The antenna 111 may be an electrical device that converts electric power into the radio signal and transmits the radio signal into vicinity of the remote controller 110 in a form of radio waves 115. The radio waves 115 may be configured to be a predetermined frequency that can be received and recognized by a respective remote receiver 120.

Although shown and described as using an antenna 111 for transmitting the radio signal into the vicinity of the remote controller 110 for purposes of illustration only, the remote controller 110 may be provided with any other suitable configurations for transmitting any suitable wireless signals. For example, as shown and described with reference to FIG. 1, the remote controller 110 may be an infrared transmitter that uses infrared signal as the control signal. In such embodiments, the remote controller 110 may be equipped with one or more infrared light-emitting diode ("LED") (not shown) for transmitting the infrared signal in a direction in which the remote controller 110 points.

When the first pushbutton 112A is clicked, an activation signal may be transmitted from the remote controller 110 via the antenna 111 or via another suitable signal source into one direction or into the vicinity of the remote controller 110. A respective remote receiver 120 may receive the control signal via a communication protocol described with reference to FIG. 1. The remote receiver 120 may receive the control signal via a receiving antenna (not shown) when the control signal is a radio wave or via some over receiving mechanisms, e.g., photo LEDs when the control signal is an infrared signal. As described with reference to FIG. 1, the remote receiver 120 may convert the control signal into an electric current that may be transmitted, via a wired link 126, to a control board (not shown) of the Halloween prop 130. When the control signal is encoded, the remote receiver 120 may first decode the control signal according to a predetermined protocol. The electric current may run to the control board via an activation port 125 of the Halloween prop 130.

A wired link 126 may be used to connect to the Halloween prop 130 via the activation port 125. The activation port 125 may be a port designed for clients to test play an animation of the Halloween prop 130 in a store so that they can experience it in action before making a decision of purchasing the Halloween prop 130. The activation port 125 may be connected with a control board of the Halloween prop 130, which may control an execution system (not shown) of the Halloween prop 130. When the activation signal is transmitted to the control board, the Halloween prop 130 may be activated according to a predetermined program.

Although shown and described as using radio frequency signal, infrared signal or Bluetooth signal for purposes of illustration only, the Halloween prop activating system 100 may use any suitable types of wireless signals for transmitting the control signal.

Figure 3A:
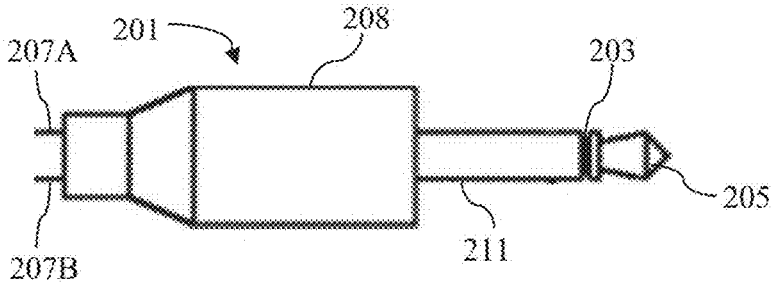
FIGS. 3A-3C show detail conceptual diagrams illustrating an example of a connection related to the system of FIG. 1.
Figure 3B:
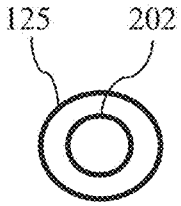
Figure 3C:
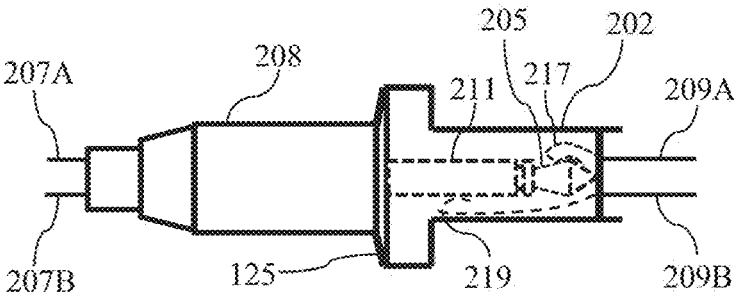

FIGS. 3A-3C illustrate an example of a connection between a remote receiver 120 and a Halloween prop 130 (collectively shown in FIG. 2) related to the Halloween prop activating system 100. In FIG. 3A, the connection may include a jack plug 201 for inserting into an activation port 125. The jack plug 201 may be an electrical connector for detachably connecting to an electrical port, e.g., the activation port 125, for transmitting an electric current and/or an electrical signal.

The jack plug 201 shown in FIG. 3A may be a form of a standard ⅛" phone type connector. The jack plug 201 may have two input wires: a first input wire 207A that connects to a tip conductor 205, and a second input wire 207B that connects to a ring conductor 211. The tip conductor 205 and the ring conductor 211 are separated by an insulator 203. Wirings and connections between the input wires 207A, 207B and the conductors 205, 211 may be encased in a plastic insulating member 208 that may be used as a handle for plugging or unplugging the jack plug 201. The input wires 207A, 207B are connected to a remote receiver 120 (not shown in FIG. 3A).

In FIG. 3B, the activation port 125 may be a socket-type port that has an aperture 202 for receiving the jack plug 201. A lateral sectional diagram of the activation port 125 is illustrated in FIG. 3C with the jack plug 201 plugged into the activation port 125. In FIG. 3C, two output wires 209A, 209B may be connected to the two input wires 207A, 207B. The first output wire 209A may be connected with the tip contact 217 that may touch the tip conductor 205 when the jack plug 201 is plugged into the activation port 125, thus, the first output wire 209A may be connected with the first input wire 207A. A second output wire 209B may be connected with the ring contact 219 that may touch the ring conductor 211 when the jack plug 201 is plugged into the activation port 125, thus, the second output wire 209B may be connected with the second input wire 207A.

Although shown and described as a jack plug 201 for purposes of illustration only, any suitable type of connector that may be coupled with the activation port 125 may be used for connecting the remote receiver 120 with the Halloween prop 130. Different remote receivers 120 may be connected with various types of connectors, e.g., jack plug 201, for engaging with different activation ports 125. Accordingly, the remote receiver 120 may be connected with any Halloween prop 130 as long as the remote receiver 120 is provided with a compatible connector that can connect the Halloween prop 130 via the activation port 125.

Figure 4:
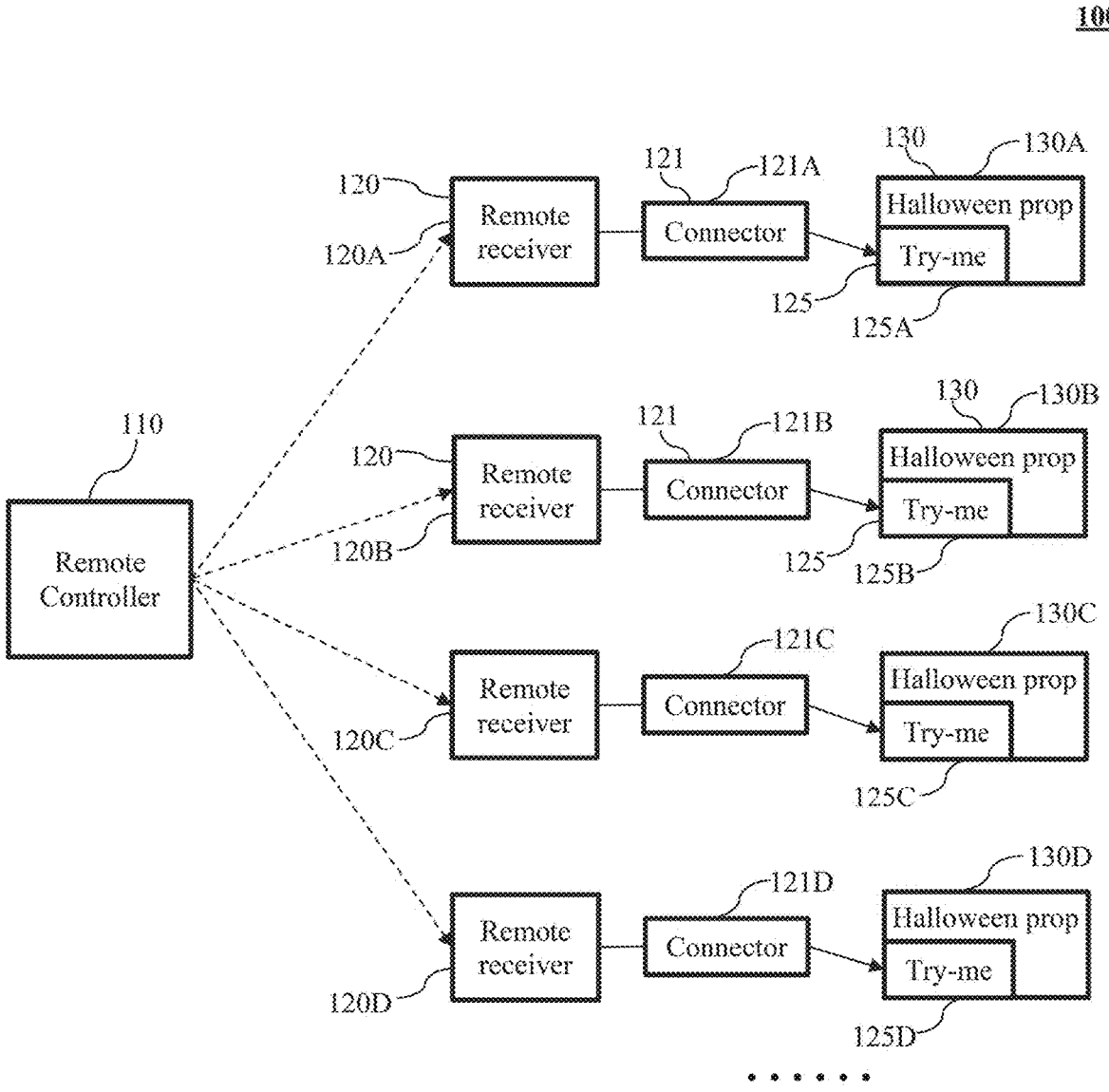
FIG. 4 shows a block diagram illustrating an example of the system of FIG. 1, where multiple Halloween props are activated by a single remote controller.

FIG. 4 illustrates a further example of the Halloween prop activating system 100. In FIG. 4, the remote controller 110 may activate a plurality of Halloween props 130 that are connected to respective remote receivers 120 via respective connectors 121 and respective activation ports 125.

The remote controller 110 may receive a user selection, i.e., which of the Halloween prop(s) 130 that the user selects to activate from the remote location. The remote controller 110 may convert the user selection into a control signal suitable for transmitting wirelessly and transmit the control signal to a direction in which the remote controller 110 points or to a vicinity of the remote controller 110. As shown and described herein, the control signal may be configured to be received and recognized by a respective remote receiver 120. The remote receiver 120 may receive the control signal via wireless channels.

Upon receiving the activation signal(s), a first remote receiver 120A, for example, may convert the signal to an electric current for activating a first Halloween prop 130A. The first remote receiver 120A may be detachably connected to the first Halloween prop 130A via a first connector 121A that may be detachably associated with a first activation port 125A of the Halloween prop 130A. Accordingly, the first remote receiver 120A may transmit the electric current to a control board (not shown) of the first Halloween prop 130A via the detachable association between the connector 121A and the first activation port 125A.

Similarly, a second remote receiver 120B may convert the signal to an electric current for activating a second Halloween prop 130B. The second remote receiver 120B may be detachably connected to the second Halloween prop 130B via a second connector 121B that may be detachably associated with a second activation port 125B of the second Halloween prop 130B. Accordingly, the second remote receiver 120B may transmit the electric current to a control board (not shown) of the second Halloween prop 130B via the detachable association between the connector 121B and the second activation port 125B.

In a similar manner shown and described herein, a third remote receiver 120C may be detachably associated with a third Halloween prop 130C via a third connector 121C and a third activation port 125C; a fourth remote receiver 120D may be detachably associated with a fourth Halloween prop 130D via a fourth connector 121D and a fourth activation port 125D. Therefore, the four Halloween props 130A-130D may be controlled by respective user selections from the remote controller 110.

Although shown and described as associating and activating four Halloween props 130A-130D for purposes of illustration only, any number of Halloween props 130 may be activated by the remote controller 110. Although the remote receivers 120 are numbered from one to four for purposes of illustration only, any one of the remote receivers 120 may be connected to another selected Halloween prop 130 via the activation 125 of the selected Halloween prop 130.

The Halloween props 130 may be activated individually or collectively via the remote controller 110 depending on a user input from the remote controller 110. An activated Halloween prop 130 may perform a predetermined program, similar to a test play that a customer may see in a store. When the predetermined routine is finished, the activated Halloween prop may be deactivated and made ready for a next activation current.

Figure 5:
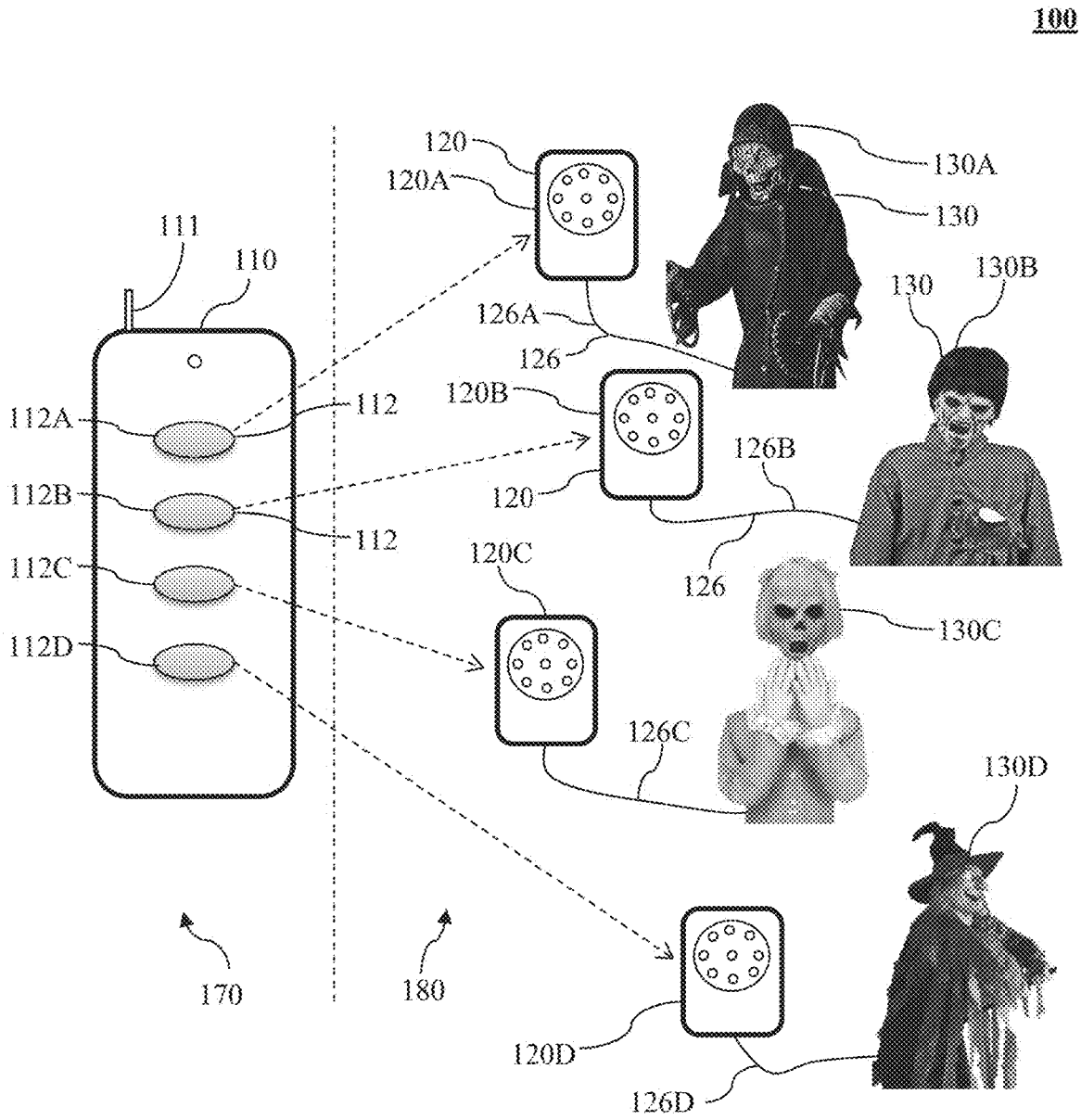
FIG. 5 shows a conceptual diagram illustrating an example of the system of FIG. 4.

FIG. 5 illustrates an example of the Halloween prop activating system 100. In FIG. 5, various types of Halloween props 130 may be wirelessly activated by a remote controller 110. The remote controller 110 may be disposed in a first location 170 and the Halloween props 130 may be disposed in a second location 180 that is different from the first location 170. For example, the remote controller 110 may be held by a user (a prank maker) who stays inside a house while the Halloween props 130 may be arranged in the user's front yard for entertaining trick-or-treaters. The Halloween props 130 may consist of any number and/or any type of Halloween props 130, and may be arranged in any patterns.

The remote controller 110 may include a plurality of pushbuttons 112, each of the which may be associated with a respective remote receiver 120, i.e., each of the pushbuttons 112 may be configured to send a control signal to the associated remote receiver 120. When a pushbutton 112, e.g., a first pushbutton 112A, is clicked, a first control signal may be transmitted in a selected direction or into a vicinity of the remote controller 110. The wireless signal may be transmitted via an antenna 111 or via another signal source as shown and described herein.

The first control signal may be received by a first remote receiver 120A. The first remote receiver 120A may be detachably associated with a first Halloween prop 130A via a wired link 126A. The wired link 126A may be connected with a connector, e.g., a jack plug 201 (shown in FIG. 3) which may be detachably plugged into a first activation port 125A (shown in FIG. 1) of the first Halloween prop 130A. The first remote receiver 120A may convert the control signal received from the remote controller 110 into an electric current and transmit the electric current to the first Halloween prop 130A. Thus, the first Halloween prop 130A may be activated by clicking the first pushbutton 112A.

Similarly, a second Halloween prop 130B, a third Halloween prop 130C and a fourth Halloween prop 130D may be activated by a user via the second pushbutton 112B, the third pushbutton 112C and the fourth push button 112D respectively. The Halloween props 130 may be activated individually or collectively by a user's click(s) on one or more of the pushbuttons 112.

If two or more of the pushbuttons 112, e.g., the first pushbutton 112A and a second pushbutton 112B are clicked substantively simultaneously or one after another, respective control signals corresponding to the selected pushbuttons 112A, 112B may be transmitted to a selected direction or into a vicinity of the remote controller 110. Each of the control signals may be received by a respective remote receiver 120, i.e., a first control signal triggered by clicking the first pushbutton 112A may be received by the first remote receiver 120A and a second control signal triggered by clicking the second pushbutton 112B may be received by the second remote receiver 120B. Respective remote receivers 120A, 120B may receive and/or identify the control signals and convert the received control signals into electric currents. The electric currents may be transmitted, via respective wired links 126A, 126B, jack plugs 201A, 201B and activation ports 125A, 125B (collectively shown in FIG. 4), to activate the Halloween props 130A, 130B respectively. Each of the Halloween props 130A, 130B may be activated to perform a predefined program of the Halloween prop 130.

According to some aspects of this disclosure, the remote controller 110 may be provided with any suitable number of pushbuttons for activating any number of Halloween props 130 from a remote location. In some embodiments, one pushbutton 112 may associate with two or more remote receivers 120, such that, when the pushbutton 112 is clicked, two or more remote receivers 120 may receive the activation signals and run electric currents to the Halloween props 130 that the remote receivers 120 connect with.

Various aspects of the disclosure have been presented above. However, the invention is not intended to be limited to the specific aspects presented above, which have been presented for purposes of illustration. Rather, the invention extends to functional equivalents as would be within the scope of the appended claims. Those skilled in the art, having the benefit of the teachings of this specification, may make numerous modifications without departing from the scope and spirit of the invention in its various aspects.

What is claimed is:

1. A system for activating multiple props, comprising:

two or more props, each of the two or more props having an activation port configured to trigger the activation of the respective prop;

a single, standalone remote controller;

two or more remote receivers, each of the two or more remote receivers configured to activate at least one of the two or more props via the prop's respective activation port upon receipt of a wireless signal from the single, standalone remote controller;

wherein the single, standalone remote controller is configured to transmit the wireless signal to at least one of the two or more remote receivers upon receiving a command from a user, the single, standalone remote controller thereby being configured to control the two or more props.

2. The system as recited in claim 1, wherein the single, standalone remote controller further comprises one or more pushbuttons, each of the one or more pushbuttons configured to trigger wireless communication with at least one of the two or more remote receivers upon depression.

3. The system as recited in claim 1, wherein the single, standalone remote controller is configured to encode the wireless signal according to a selected protocol; and the two or more remote receivers are configured to decode the wireless signal according to the selected protocol.

4. The system as recited in claim 1, wherein the wireless signal transmitted by the single, standalone remote controller comprises at least one of an infrared signal, a radio frequency signal, a Bluetooth signal, and a wireless internet signal.

5. The system as recited in claim 4, wherein the single, standalone remote controller transmits the wireless signal in a particular direction.

6. The system as recited in claim 1, wherein each remote receiver is connected to at least one of the two or more props via a wired link.

7. The system as recited in claim 6, wherein each remote receiver is configured to convert a received wireless signal into an electric current for activating the connected two or more props via the wired link.

8. The system as recited in claim 6, wherein the wired link comprises at least one of a conductive wire or cable terminating in a jack plug;

wherein the activation port of the prop comprises a socket-type port having an aperture for receiving the jack plug.

9. The system as recited in claim 8, wherein the jack plug further comprises a first input wire connected to a tip conductor, and a second input wire connected to a ring conductor, the tip conductor and ring conductor being separated by an insulator;

the activation port further comprises a first output wire connected a tip contact and a second output wire connected to a ring conduct;

wherein the tip contact is configured to touch the tip conductor and the ring contact is configured to touch the ring conductor upon insertion of the jack plug into the aperture.

10. A method for activating two or more props, comprising:

transmitting, via a single, standalone remote controller, a wireless signal to two or more remote receivers, the selection of the two or more remote receivers being dependent upon a user input received by the single, standalone remote controller;

activating, via at least one of the two or more remote receivers, at least one of the two or more props through transmission of an electrical current from the respective remote receiver to an activation port on the respective prop, the single, standalone remote controller thereby controlling the two or more props.

11. The method as recited in claim 10, further comprising:

encrypting, via the single, standalone remote controller, the wireless signal according to a particular protocol; and decrypting, via the remote receiver, the wireless signal according to the particular protocol.

12. The method as recited in claim 10, further comprising:

converting, via the remote receiver, the wireless signal into the electrical current.

13. The method as recited in claim 10, further comprising:

receiving, via one or more pushbuttons on the single, standalone remote controller, a user input.

* * * * *